US010122121B2

(12) United States Patent
Toh et al.

(10) Patent No.: US 10,122,121 B2
(45) Date of Patent: Nov. 6, 2018

(54) LOCKING CONNECTOR

(71) Applicant: VOLEX PLC, London (GB)

(72) Inventors: Mui Lian Jessica Toh, Singapore (SG); Kar Boon Chua, Singapore (SG)

(73) Assignee: VOLEX PLC, London (GB)

( * ) Notice: Subject to any disclaimer, the term of this patent is extended or adjusted under 35 U.S.C. 154(b) by 0 days.

(21) Appl. No.: 15/685,599

(22) Filed: Aug. 24, 2017

(65) Prior Publication Data

US 2018/0159273 A1 Jun. 7, 2018

Related U.S. Application Data

(60) Provisional application No. 62/430,294, filed on Dec. 5, 2016.

(51) Int. Cl.

| | |
|---|---|
| ***H01R 13/62*** | (2006.01) |
| ***H01R 13/633*** | (2006.01) |
| ***H01R 13/635*** | (2006.01) |
| *H01R 13/08* | (2006.01) |

(52) U.S. Cl.

CPC ..... *H01R 13/6335* (2013.01); *H01R 13/635* (2013.01); *H01R 13/08* (2013.01)

(58) Field of Classification Search

CPC .. H01R 13/6335; H01R 13/635; H01R 13/08; F16L 37/0841; F03D 7/0224

USPC ..... 439/304

See application file for complete search history.

(56) References Cited

U.S. PATENT DOCUMENTS

| | | | | |
|---|---|---|---|---|
| 2,666,149 A * | 1/1954 | Fumagalli | F03D 7/0224 290/44 |
| 2004/0171916 A1* | 9/2004 | Brommersma | F16L 37/0841 600/162 |

* cited by examiner

*Primary Examiner* — Jean F Duverne
(74) *Attorney, Agent, or Firm* — Baker & Hostetler LLP

(57) ABSTRACT

A connector is configured to be removably engaged with and locked to an inlet. The connector comprises a locking member and a release member. The locking member is configured to impose a force on an inlet blade so as to lock the connector to the inlet when the connector is fully inserted into the inlet. The locking member comprises a compressible portion having an opening that is sufficiently large to allow the inlet blade to slide through under pressure but sufficiently small to form at least one contact point between the inlet blade and the compressible portion in its uncompressed state so as to impose the force on the inlet blade. The release member is configured to release the force imposed by the locking member on the inlet blade so as to disengage the connector from the inlet.

20 Claims, 10 Drawing Sheets

LOCKING CONNECTOR

CROSS REFERENCE TO RELATED APPLICATIONS

This application claims benefit under 35 U.S.C. § 119(e) of Provisional U.S. Patent Application No. 62/430,294, filed Dec. 5, 2016, the contents of which is incorporated herein by reference in its entirety.

TECHNICAL FIELD

The present disclosure relates to a connector, more particularly to a connector with a locking mechanism.

BACKGROUND

Connectors are commonly used to supply power to electronic devices, such as personal computers. A connector in electrical communication with a source of electrical power is typically engaged with an inlet in order to supply electrical power to an electronic device. However, a significant risk exists that the connector will inadvertently disengage from the inlet, potentially causing damage to the electronic device and/or injury to a user.

SUMMARY

The present disclosure aims at overcoming the weaknesses of conventional connectors and providing a connector with a locking mechanism. The illustrative embodiments described below provide a connector that incorporates a locking mechanism into the connector housing.

In accordance with an aspect of the present disclosure, there is provided a connector which is configured to be removably engaged with and locked to an inlet. The connector comprises a locking member and a release member. The locking member is configured to impose a force on an inlet blade so as to lock the connector within an inlet when the connector is fully inserted into the inlet. The locking member comprises a compressible portion having an opening that is sufficiently sized to allow an inlet blade to slide through under pressure, but sufficiently small to form at least one contact point between the inlet blade and the compressible portion in its uncompressed state so as to impose the force on the inlet blade. The release member is configured to release the force imposed by the locking member on the inlet blade so as to allow the connector to be disengaged from the inlet.

In accordance with a second aspect of the present disclosure, there is provided a connector system. The connector system comprises an inlet and a connector configured to be removably engaged with and locked to the inlet. The connector includes a locking member and a release member. The locking member is configured to engage a blade of the inlet and impose a force on the blade so as to lock the connector within the inlet. The locking member comprises a compressible portion having an opening that is sufficiently sized to allow an inlet blade to slide through under pressure, but sufficiently small to form at least one contact point between the inlet blade and the compressible portion in its uncompressed state so as to impose the force on the inlet blade. The release member is configured to engage the locking member and release the force imposed by the locking member on the inlet blade so as to allow the connector to be disengaged from the inlet.

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

BRIEF DESCRIPTION OF THE DRAWINGS

Embodiments of the present disclosure will be described more fully hereinafter with reference to the accompanying drawings, in which.

DETAILED DESCRIPTION OF ILLUSTRATIVE EMBODIMENTS

Figure 1:
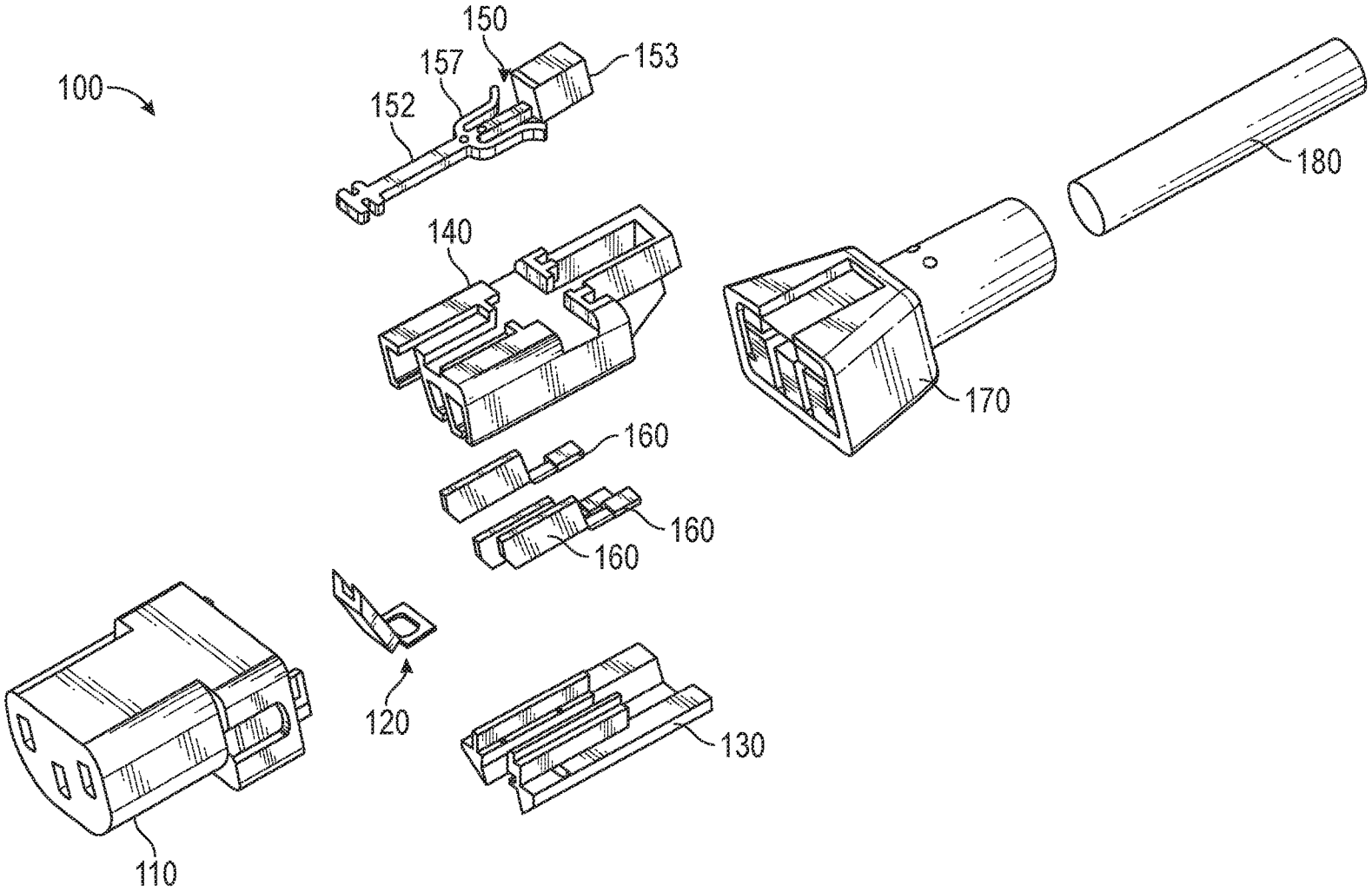
FIG. 1 is an exploded view showing a connector of the present disclosure.

While embodiments of an electrical connector, for convenience and simplicity, are illustrated in the drawings and described herein, it is to be understood that the present disclosure is not limited to electrical connectors and could equally apply to any type of connector, including data and signal connectors and non-electrical connectors, such as optical connectors.

FIG. 1 illustrates an exploded view of a connector 100 of the present disclosure. As shown, the connector 100 may include an outer housing 110, a locking member 120, a first inner housing 130, a second inner housing 140, a release member 150, terminals 160, an over mold 170, and a cable 180. The connector 100 is configured to be removably engaged with and locked to an inlet (not shown) via the locking member 120.

Figure 2A:
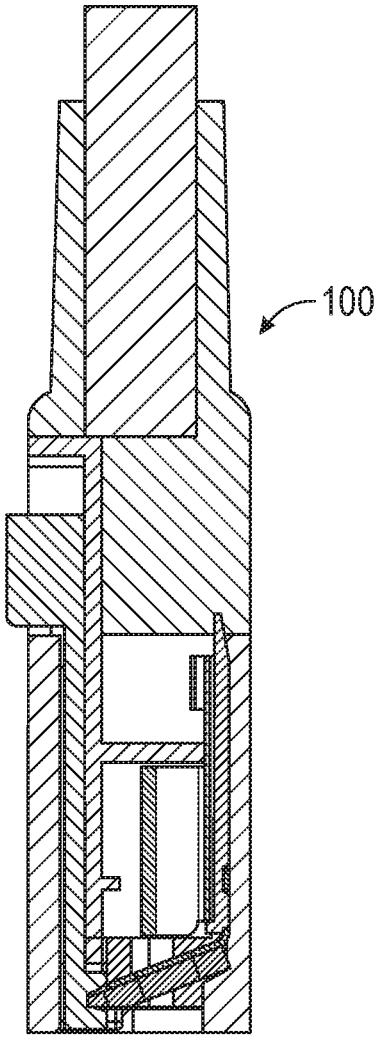
FIGS. 2A-2D illustrate an uncompressed state of a locking member before a connector is inserted into an inlet.
Figure 2B:
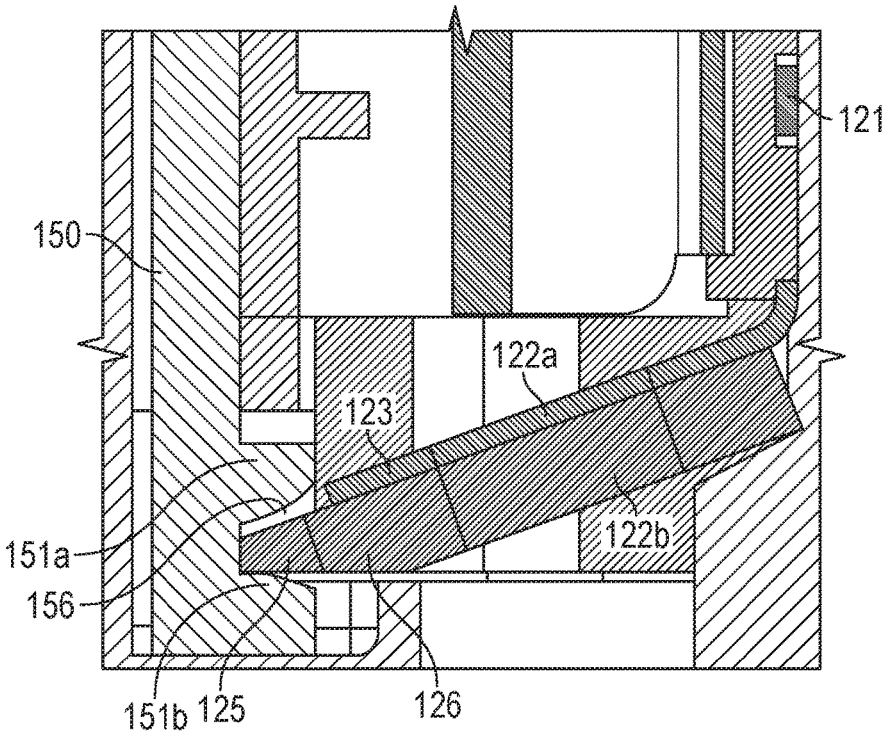

As shown in FIGS. 1 and 2B, the locking member 120 includes a first arm 121 and a second arm 123. The locking member 120 is formed of any suitable resilient material, such as plastic and metal. In some embodiments, the first arm 121 may be configured to be inserted and constraint between the first inner housing 130 and the second inner housing 140. In other embodiments, as particularly illustrated in FIG. 2B, the first arm 121 may be retained in place by a protrusion formed on the first inner housing 130.

The locking member 120 further comprises a gripping piece 126. The gripping piece 126 may be coupled to the second arm 123 by any suitable ways, such as by spot-welding. The gripping piece 126 may be formed of any suitable material, such as metal. The second arm 123 and the gripping piece 126 are free and compressible. Preferably, the second arm 123 and the gripping piece 126 are sufficiently flexible to enable it be compressed repeatedly without breaking, but sufficiently rigid so as to form a firm lock for the connector 100 when locked within an inlet. An extension portion 125 is formed at the free end of the gripping piece 126. The extension portion 125 is configured to be able to engage the release member 150. By way of example and without limitation, the extension portion 125 may be configured to insert a groove 156 formed at an end of the release member 150 (as show in FIGS. 2A and 2B).

A first opening 122*a* and a second opening 122*b* are formed in the second arm 123 and the gripping piece 126, respectively. The first opening 122*a* and the second opening 122*b* may be rectangle-shaped. Preferably, the first opening 122*a* and the second opening 122*b* have the same size. As more particularly shown in FIG. 3B, the first opening 122*a* and the second opening 122*b* are sized sufficiently large to allow an inlet blade 200 to slide through when the connector is pushed into an inlet by a user, but sufficiently small to enable to form at least a gripping point between the inlet blade 200 and the locking member 120 when the second arm 123 and the gripping piece 126 are reverted to their uncompressed states. As can be appreciated by those skilled in the art, the first opening 122*a* and the second opening 122*b* may be sized to accommodate a blade of any inlet to which the connector 100 connects, thereby locking the connector 100 to any inlet via at least a gripping point formed between an inlet blade and the locking member 120.

Figure 2C:
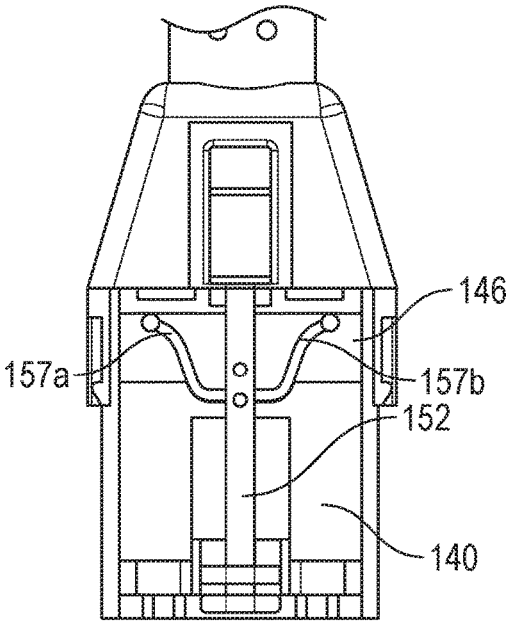
Figure 2D:
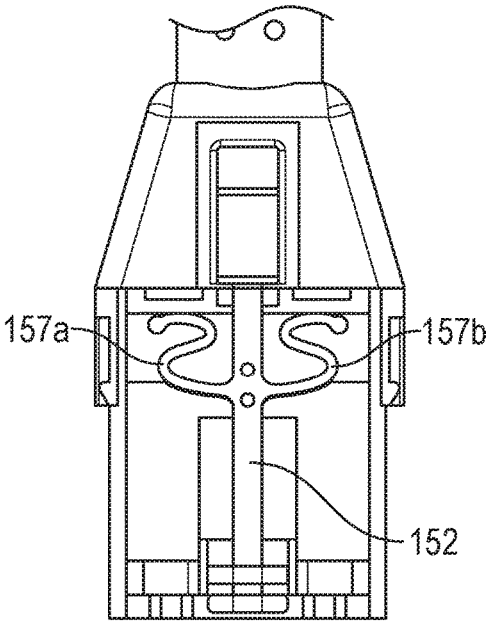

A resilient structure 157 may be provided to strengthen gripping forces imposed on the inlet blade 200 by the locking member 120. The resilient structure 157 may be made of any suitable material, such as plastic. The resilient structure 157 may be shaped in any suitable form, such as a bow shape. For instance, the resilient structure 157 may be a bow spring. By way of example and without limitation, the resilient structure 157 comprises a pair of arms 157*a* and 157*b* that may be formed on opposite sides of the arm 152 of the release member 150. As shown in FIG. 2C, the pair of arms 157*a* and 157*b* may extend upward and away from the arm 152, which renders the resilient structure 157 bow-shaped. Alternatively, as illustrated in FIG. 2D, the pair of arms 157*a* and 157*b* each may be S-shape and symmetrically disposed around the arm 152. The pair of arms 157*a* and 157*b* may be positioned into a groove 146 formed in the second inner housing 140, and they are preloaded in this stage to retain the second arm 123 and the gripping piece 126 in their uncompressed states.

Figure 3A:
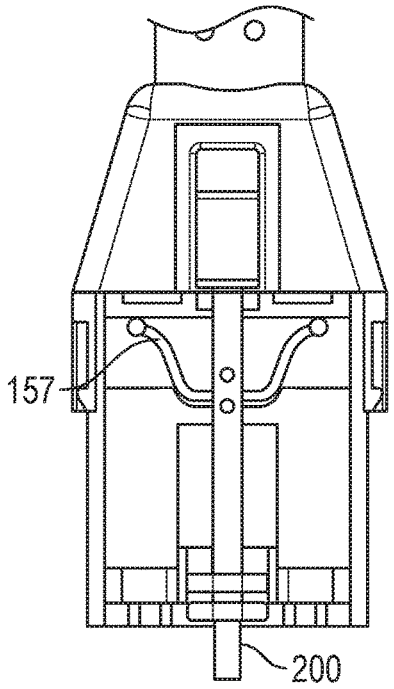
FIGS. 3A and 3B illustrate a compressed state of a locking member when a connector is being inserted into an inlet.
Figure 3B:
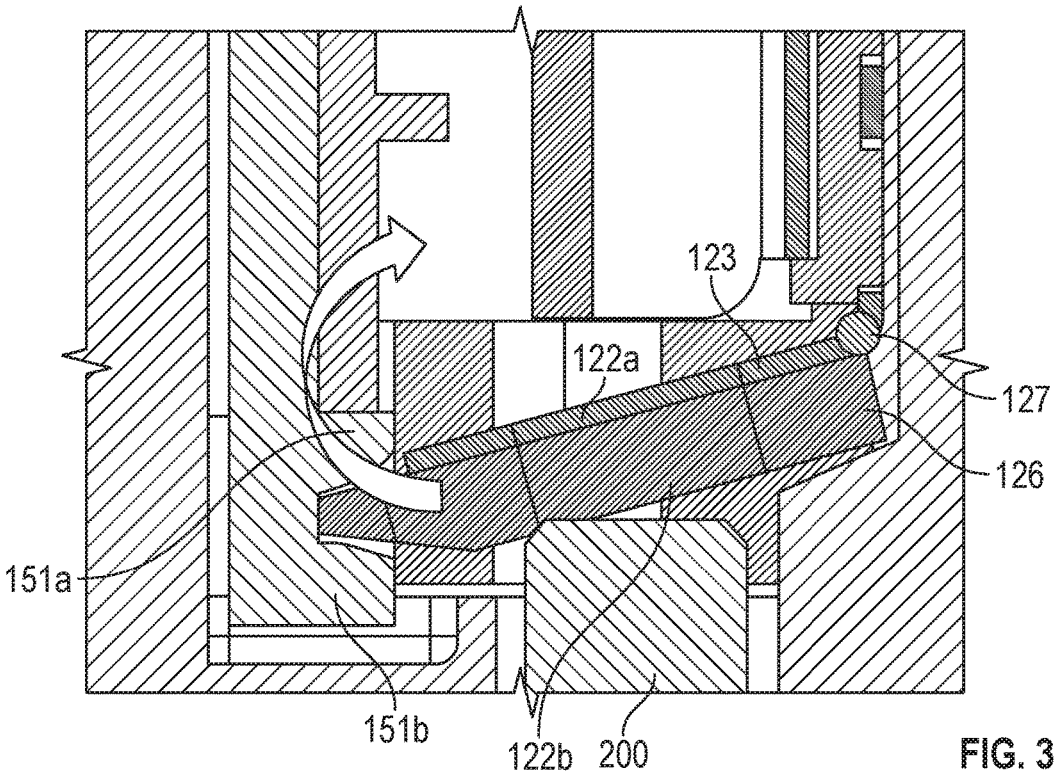
Figure 4:
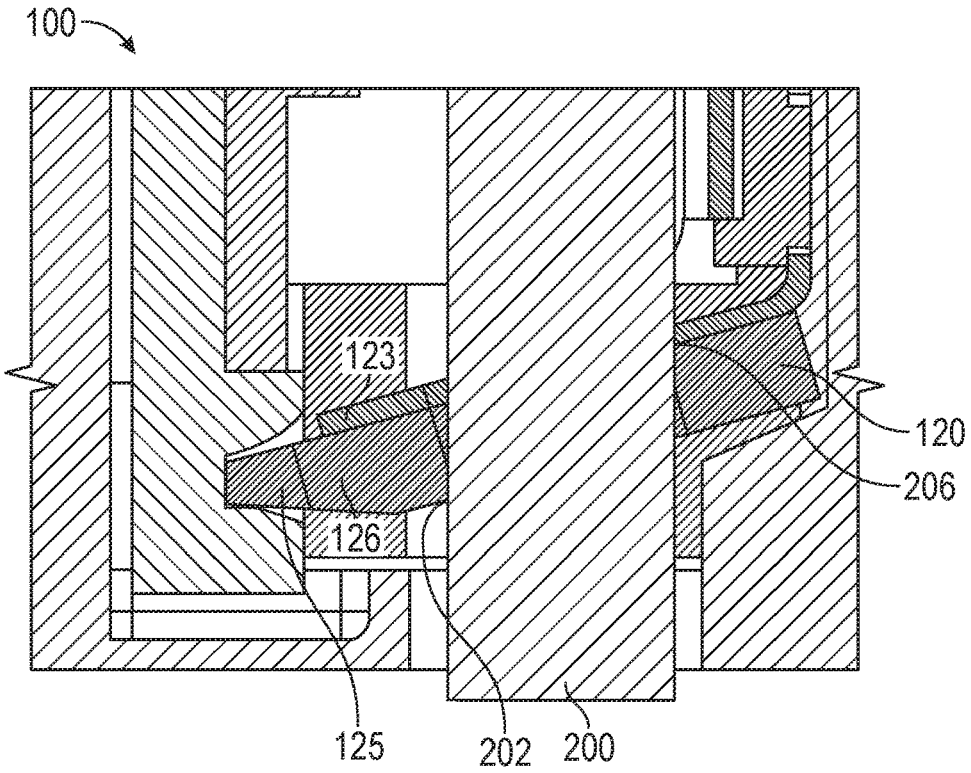
FIG. 4 illustrates a locking state after a connector is fully inserted into an inlet.

To plug the connector 100 into an inlet, a user simply aligns and inserts the connector 100 into the inlet with sufficient force or pressure to cause the second arm 123 and the gripping piece 126 of the locking member 120 and the resilient structure 157 to be compressed when the locking member 120 comes into contact with the inlet blade 200. When the locking member 120 is being compressed, the second arm 123 and the gripping piece 126 may rotate relative to a pivot point 127 (as shown in FIG. 3B). The inlet blade 200 compresses the second arm 123 and the gripping piece 126 until the inlet blade 200 slides through the first opening 122*a* and the second opening 122*b*. In some embodiments, as more particularly shown in FIGS. 4A and 4B, when the connector 100 is fully inserted into the inlet, the second arm 123 and the gripping piece 126 of the locking member 120 will revert to their uncompressed states and form a first gripping point 202 and a second gripping point 206 between the inlet blade 200 and the locking member 120, thereby imposing gripping forces on the inlet blade 200 so as to lock the connector 100 within the inlet and prevent the connector 100 from sliding out of the inlet.

The connector 100 is locked in place until the connector 100 is purposely disengaged from the inlet by pulling the release member 150. The release member 150 is configured to engage the locking member 120 and impose a release force on the locking member 120, thereby disengaging the locking member 120 from the inlet blade 200 so as to enable to pull the connector 100 away from the inlet.

As shown in FIG. 1, the release member 150 may comprise an arm 152, a handle 153 and the resilient structure 157. By way of example and without limitation, a pair of protrusions 151*a* and 151*b* may be formed at an end of the arm 152; the groove 156 for receiving the extension portion 125 of the griping piece 126 may be formed between the pair protrusions 151*a* and 151*b* (more particularly shown in FIGS. 2B and 5B). The arm 152 may be configured to be inserted between the outer housing 110 and the second inner housing 140. The handle 153 may be configured to protrude a certain height above an outer surface of the connector 100 so that it can be pulled by a user. The handle 153 may be disposed within a groove 142 formed in the second inner housing 140 and movable along the groove 142 when pulled by a user (as shown in FIG. 5A).

Figure 5A:
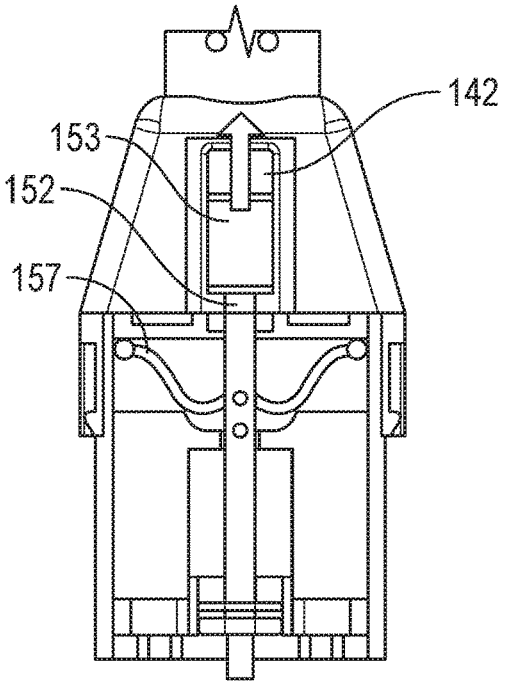
FIGS. 5A and 5B illustrate a release member engaging a locking member so as to allow a connector to be pulled out of an inlet.
Figure 5B:
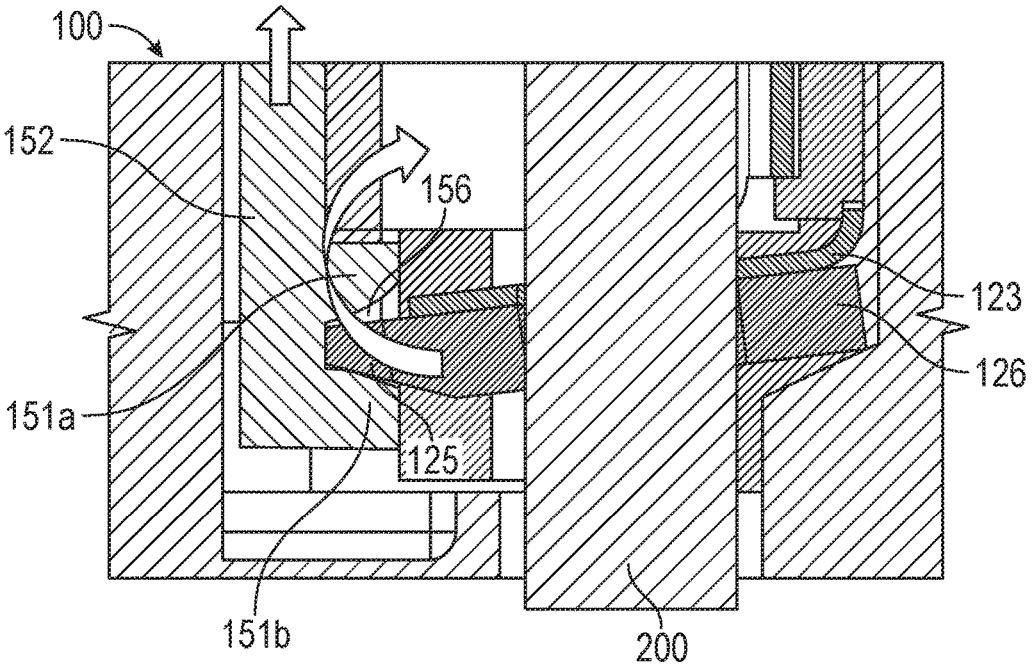
Figure 6A:
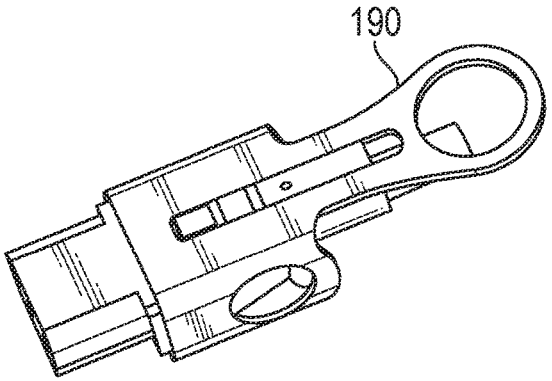
FIGS. 6A-6D illustrate a pull tab of a connector of the present disclosure.
Figure 6B:
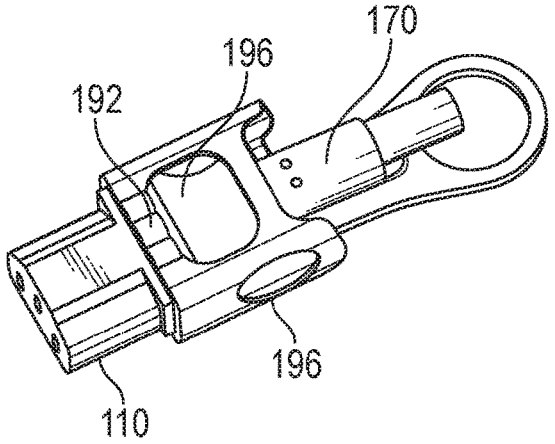
Figure 6C:
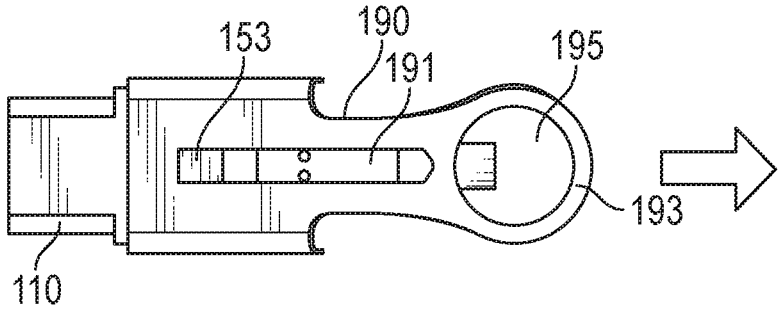
Figure 6D:
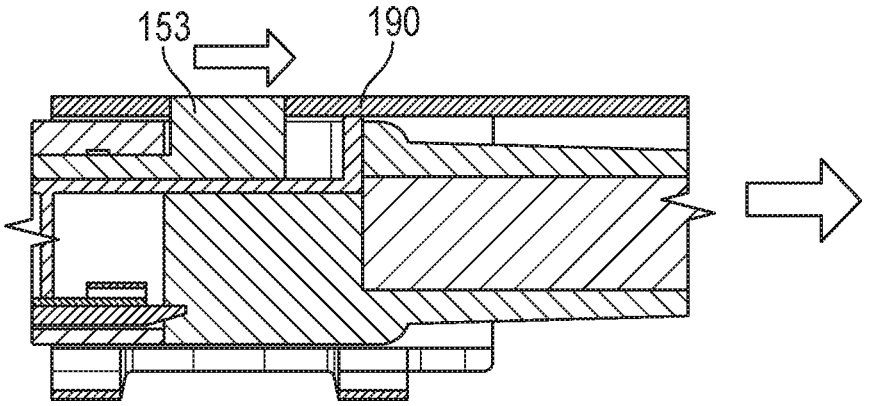

FIGS. 5A and 5B illustrate a process of disengaging the connector 100 from the inlet. To disengage the connector 100 from the inlet, a user pulls the handle 153 of the release member 150 back toward the cable 180. As illustrated, when the handle 153 of the release member 150 is pulled backward, the second arm 123, the gripping piece 126, and the resilient structure 157 are compressed, thereby reducing and eventually eliminating the gripping forces imposed on the inlet blade 200 by the locking member 120 so as to allow the connector 100 to be withdrawn from the inlet.

As illustrated in FIGS. 6A, 6B, 6C and 6D, a pull tab 190 is optionally provided to facilitate a user to pull the handle 153 so as to disengage the connector 100 from the inlet. When the handle 153 of the release member 150 is difficult to access, for instance, when multiple connectors are positioned close to each other, the pull tab 190 may allow for a user to manipulate the handle 153. The pull tab 190 is capable of sliding along the outer housing 110 and the over mold 170.

By way of example and without limitation, the pull tab 190 comprises a slot 191 formed in an upper wall of the pull tab 190 and a grip member 193. The slot 191 is configured to receive and engage the handle 153 of the release member 150 so as to move the handle 153 when a user pulls the grip member 193. Preferably, the slot 191 is shaped like a long and narrow rectangle. The grip member 193 may be shaped in any suitable manner so that a user can easily grip and pull the grip member 193. For instance, an opening 195 may be formed in the grip member 193. Optionally, three more openings 196 (only two of which is visible in FIG. 6B) may be formed in two side walls and a bottom wall of the pull tab 190, respectively, so as to further facilitate a user to grip the pull tab 190. A wavy structure 192 may be formed on the outside surface of the bottom wall of the pull tab 190.

Figure 7A:
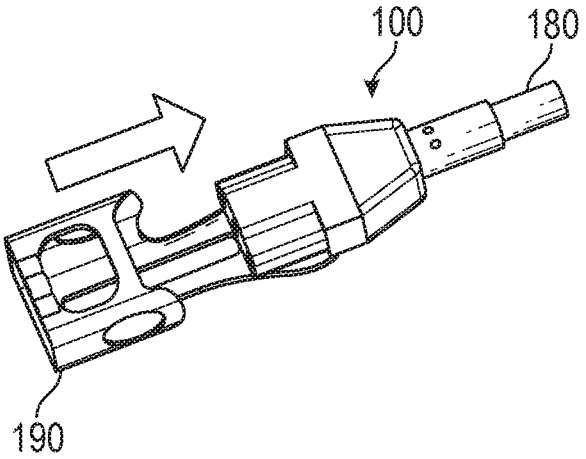
FIGS. 7A-7G illustrate a process of engaging a pull tab with a connector of the present disclosure.
Figure 7B:
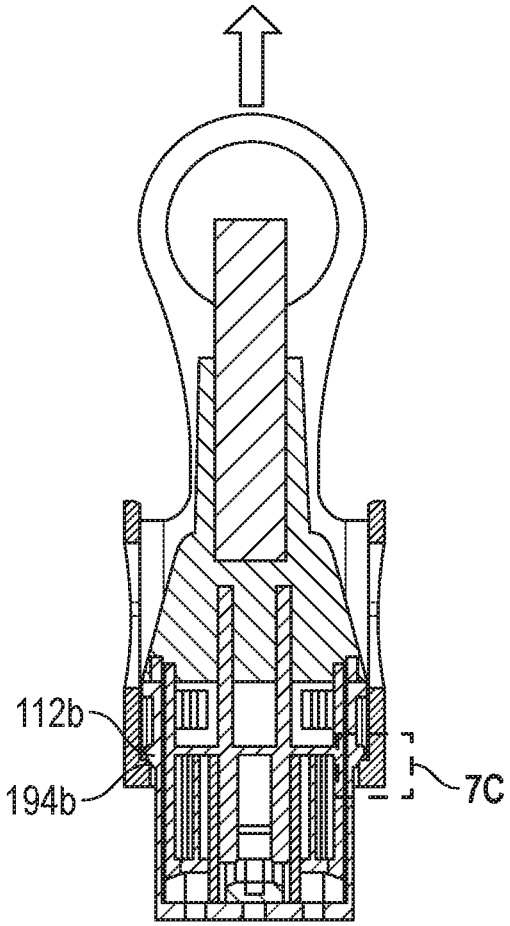
Figure 7C:
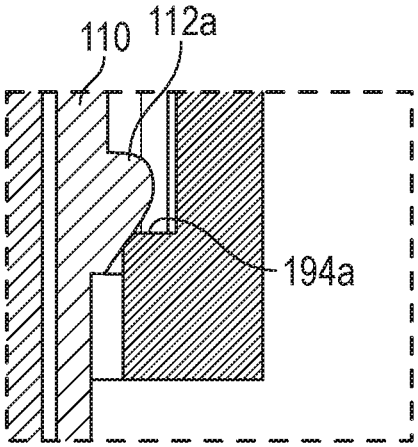
Figure 7D:
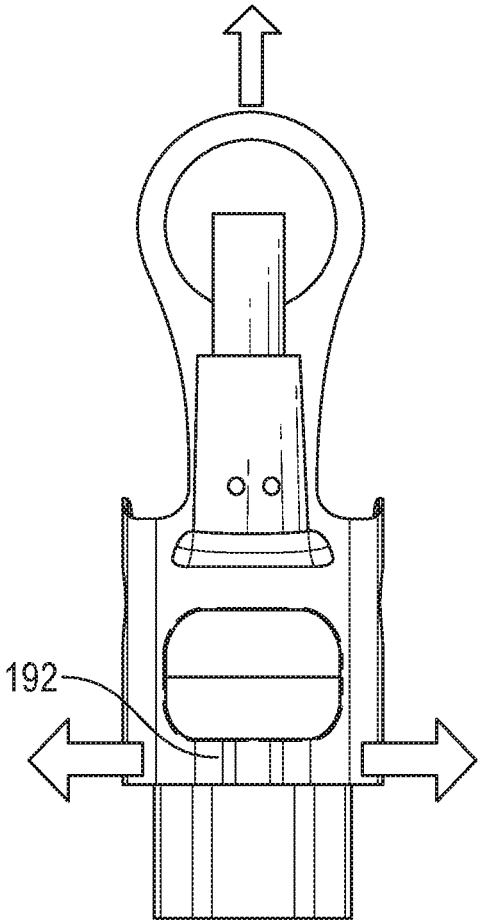
Figure 7E:
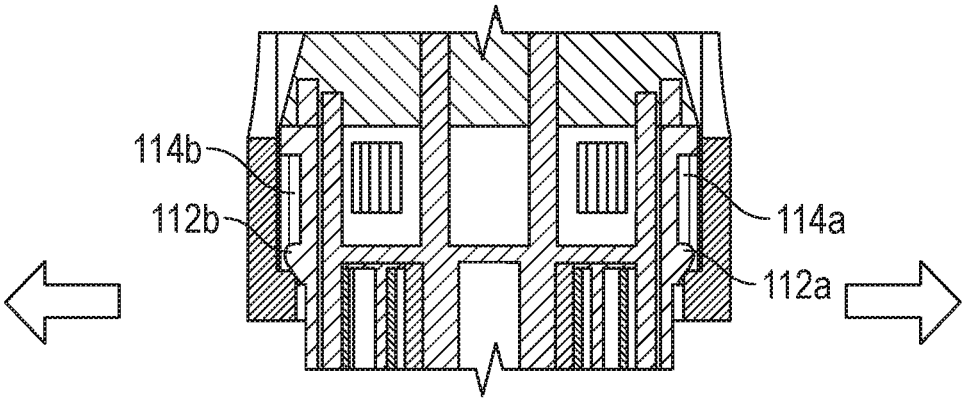
Figure 7F:
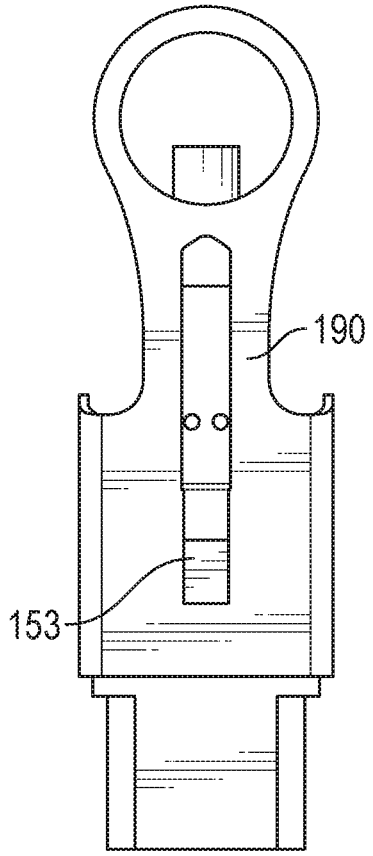
Figure 7G:
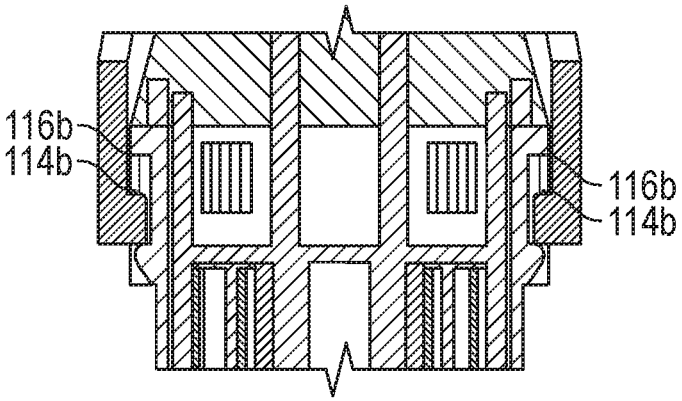

As more particularly shown in FIGS. 7B and 7C, a pair of protrusions 194*a* and 194*b* may be formed on two inner side surfaces of the pull tab 190, respectively; a pair of ramps 112*a* and 112*b* may be formed on two outer side surfaces of the outer housing 110, respectively. As shown in FIG. 7G, two grooves 114*a* and 114*b* for guiding the sliding of the pull tab 190 along the outside housing 110 may be formed in the two outer side surfaces of the outer housing 110, respectively. Two stoppers 116*a* and 116*b* for stopping the sliding of the pull tab 190 may be formed at the ends of the grooves 114*a* and 114*b*, respectively.

FIGS. 7A-7G illustrate a process of installing the pull tag 190. A user simply aligns and pulls the pull tab 190 onto the connector 100 and back toward the cable 180. When the protrusions 194*a* and 194*b* of the pull tab 190 come into contact with the ramps 112*a* and 112*b* formed on the outer housing 110, respectively, the user exerts a stronger pull force to overcome obstruction caused by the ramps 112*a* and 112*b*. The wavy structure 192 of the pull tab 190 allows the pull tab 190 to expand sideward and outward, thereby facilitating to overcome the obstruction caused by the ramps 112*a* and 112*b*. After the pull tab 190 is pulled past the ramps 112*a* and 112*b*, the sliding of the pull tab 190 is guided by the two grooves 114*a* and 114*b* by constraining movement of the protrusions 194*a* and 194*b* within the two grooves 114*a* and 114*b*, respectively. Both the handle 153 of the release member 150 and the stoppers 116*a* and 116*b* serve to prevent the pull tab 190 from being pulled out in a direction toward the cable 180.

Although embodiments of the present disclosure have been illustrated in conjunction with the accompanying drawings and described in the foregoing detailed description, it should be appreciated that the invention is not limited to the embodiments disclosed and is capable of numerous rearrangements, modifications, alternatives, and substitutions without departing from the spirit of the disclosure as set forth and recited by the following claims.

What is claimed:

1. A connector, comprising:

a locking member configured to lock the connector within an inlet including an inlet blade, wherein the locking member includes a compressible portion having walls forming an opening within the compressible portion, the opening being sufficiently sized to allow the inlet blade to slide through the opening under pressure and to form at least one contact point between the inlet blade and the walls of the compressible portion, the at least one contact point imposing sufficient force on the inlet blade when the compressible portion is in its uncompressed state to lock the inlet blade within the connector; and a release member configured to compress the compressible portion so the walls of the compressible portion reduce the force on the inlet blade sufficient to release the inlet blade so as to disengage the connector from the inlet.

2. The connector of claim 1, wherein the compressible portion comprises a first piece and a second piece.

3. The connector of claim 2, wherein the first piece is coupled to the second piece by spot-welding.

4. The connector of claim 1, wherein the release member comprises a resilient structure capable of being preloaded to retain the compressible portion of the locking member in its uncompressed state.

5. The connector of claim 4, wherein the resilient structure is a bow spring.

6. The connector of claim 1, wherein the release member comprises a handle configured to protrude from an outer surface of the connector.

7. The connector of claim 1, further comprising:

a pull member capable of engaging the release member to facilitate a disengagement of the connector from the inlet.

8. The connector of claim 7, wherein the pull member is capable of sliding along an outer housing of the connector, a sliding of the pull member is guided by at least one guiding member.

9. A connector, comprising:

a locking member configured to lock the connector within an inlet including an inlet blade, wherein the locking member includes a compressible portion having walls forming an opening within the compressible portion, the opening being sufficiently sized to allow the inlet blade to slide through the opening under pressure and to form at least one contact point between the inlet blade and the walls of the compressible portion, the at least one contact point imposing sufficient force on the inlet blade when the compressible portion is in its uncompressed state to lock the inlet blade within the connector;

a release member configured to compress the compressible portion so the walls of the compressible portion reduce the force on the inlet blade sufficient to release the inlet blade so as to disengage the connector from the inlet; and a pull member configured to engage the release member to release the inlet blade, the pull member surrounding at least a portion of an outer housing of the connector, the pull member including a wavy structure configured to allow the pull member to expand sideways around the outer housing of the connector.

10. The connector of claim 9, wherein the pull member is further configured to slide along the outer housing of the connector, further comprising:

at least one stopper configured to stop the sliding of the pull member along the outer housing of the connector.

11. A connector system, comprising:

an inlet comprising a blade; and a connector configured to be removably engaged with and locked to the inlet, the connector including:

a locking member configured to lock the connector within the inlet, wherein the locking member includes a compressible portion having walls forming an opening within the compressible portion that is sized to allow the blade to slide through the opening under pressure while forming at least one contact point between the blade and the wall of the compressible portion, the at least one contact point imposing sufficient force on the blade when the compressible portion is in its uncompressed state to lock the blade within the connector, and a release member configured to engage the locking member to compress the compressible portion so the walls of the compressible portion release the force imposed by the locking member on the blade so as to disengage the connector from the inlet.

12. The connector system of claim 11, wherein the compressible portion comprises a first piece and a second piece.

13. The connector system of claim 12, wherein the first piece is coupled to the second piece by spot-welding.

14. The connector system of claim 11, wherein the release member comprises a resilient structure capable of being preloaded to retain the compressible portion of the locking member in its uncompressed state.

15. The connector system of claim 14, wherein the resilient structure is a bow spring.

16. The connector system of claim 11, wherein the release member comprises a handle configured to protrude from an outer surface of the connector.

17. The connector system of claim 11, further comprising:

a pull member capable of engaging the release member to facilitate a disengagement of the connector from the inlet.

18. The connector system of claim 17, wherein the pull member is capable of sliding along an outer housing of the connector, a sliding of the pull member guided by at least one guiding member.

19. A connector system, comprising:

an inlet comprising a blade; and a connector configured to be removably engaged with and locked to the inlet, the connector including:

a locking member configured to lock the connector within the inlet, wherein the locking member includes a compressible portion having walls forming an opening within the compressible portion that is sized to allow the blade to slide through the opening under pressure while forming at least one contact point between the blade and the wall of the compressible portion, the at least one contact point imposing sufficient force on the blade when the compressible portion is in its uncompressed state to lock the blade within the connector, a release member configured to engage the locking member to compress the compressible portion so the walls of the compressible portion release the force imposed by the locking member on the blade so as to disengage the connector from the inlet, and a pull member configured to engage the release member to release the blade, the pull member surrounding at least a portion of an outer housing of the connector, the pull member including a wavy structure configured to allow the pull member to expand sideways around the outer housing of the connector.

20. The connector system of claim 19, wherein the pull member is further configured to slide along the outer housing of the connector and wherein the connector further comprises at least one stopper configured to stop the sliding of the pull member along the outer housing of the connector.

* * * * *